United States Patent [19]

Bird

[11] Patent Number: 4,939,992

[45] **Date of Patent: * Jul. 10, 1990**

[54] FLEXOGRAPHIC COATING AND/OR PRINTING METHOD AND APPARATUS INCLUDING INTERSTATION DRIERS

[75] Inventor: John W. Bird, Westport, Conn.

[73] Assignee: Birow, Inc., Westport, Conn.

[ * ] Notice: The portion of the term of this patent subsequent to Jun. 27, 2006 has been disclaimed.

[21] Appl. No.: 336,219

[22] Filed: Apr. 11, 1989

Related U.S. Application Data

[63] Continuation-in-part of Ser. No. 65,914, Jun. 24, 1987, Pat. No. 4,841,903.

[51] Int. Cl.[5] ..... B41F 5/24

[52] U.S. Cl. ..... 101/183; 101/424.1; 101/488; 101/211; 118/46

[58] Field of Search ..... 101/115, 488, 424.1, 101/183, 138, 136, 177, 181; 118/46, 66, 58; 427/378, 379, 382; 34/1 SS

[56] References Cited

U.S. PATENT DOCUMENTS

| | | | |
|---|---|---|---|
| 2,359,825 | 10/1944 | Campbell | 101/115 |
| 3,040,657 | 6/1962 | Ichinose | 101/115 |
| 3,121,642 | 2/1964 | Biskup | 427/199 |
| 3,221,646 | 12/1965 | Hardy, Jr. et al. | 101/115 |
| 4,841,903 | 6/1989 | Bird | 101/217 X |

*Primary Examiner*—Clifford D. Crowder
*Attorney, Agent, or Firm*—Perman & Green

[57] ABSTRACT

A straight line flexographic printing method and machine having a plurality of in-line liquid application stations, at least one of which is an upstream ink image-printing stations for printing ink images on a succession of cardboard copy sheets, and at least one of which is a final downstream liquid-application station which may be a coating application station for printing a protective, and/or aesthetic coating over selected portions of, or over the entire ink image-printed surface of each cardboard copy sheet. The present method and apparatus involves the placement of a forced hot air drying station between each of the liquid application stations to evaporate volatile solvent/diluent from the ink images applied at each inking or coating station before the application of additional ink images or coatings thereover at the next downstream liquid application station.

11 Claims, 1 Drawing Sheet

FLEXOGRAPHIC COATING AND/OR PRINTING METHOD AND APPARATUS INCLUDING INTERSTATION DRIERS

BACKGROUND OF THE INVENTION

The present application is a continuation-in-part of application Ser. No. 65,914 filed June 24, 1987, now U.S. Pat. No. 4,841,903.

Conventional flexographic coating and/or printing machines or presses comprise one or more image-printing stations each having a plate cylinder to which is fastened a flexographic plate having raised image or printing areas. Aqueous or solvent ink is applied to the raised image areas, which ink is transferred directly to an absorbent copy sheet or web.

This differs from lithographic printing in which the flat, imaged surface of a plate is continuously wetted with aqueous damping solution, which adheres only to the background areas, and the plate is then inked with oleoresinous ink composition which adheres only to the image areas of the plate as wet ink. The ink is offset-transferred to the rubber surface of a contacting blanket cylinder, and retransferred to the receptive surface of a copy web or a succession of copy sheets, such as of paper, where the ink gradually hardens or cures by oxidation, in some cases after passing through a final drying station located downstream of the final liquid application station where the volatile solvent is evaporated from the ink composition of the images.

In multicolor printing processes and machines of both flexographic and lithographic types, the copy web or sheets pass through a plurality of ink-printing stations in which inks of different colors are printed over the same areas in partial or complete registration to produce multi-ink images or image portions having a variety of desired colors or color-blends. However such multi-ink images vary in sharpness, color-intensity and tone or hue depending upon the number of underlying ink portions.

Stiff, heavyweight cardboard sheets, such as corrugated cardboard, can only be printed and/or coated on a straight line flexographic printer and/or coater since such sheets cannot be caused to wrap around and over plate cylinders or impression cylinders, as is common with lithographic presses and with some known flexographic presses which are used for printing flexible sheets.

Flexographic straight-line printing machines are employed for the printing of relatively thick sheets of highly absorbent material, such as corrugated cardboard, which are moved in a straight line, in flat condition, through one or more ink-printing stations. At each such station the thick absorbent sheets pass in the nip between a flexographic plate cylinder and an impression or back-up cylinder, the raised images on the plate applying flexographic ink directly to the absorbent surface of each sheet, such as cardboard. The flexographic ink comprises resin, pigment and volatile diluents and/or solvent and dries by the absorption of the diluent/solvent into the absorbent surface. This results in some spreading of the printed images, lines, etc., with resultant loss of sharpness, detail and quality of print. This is particularly true where different colored inks are printed in partial or complete registration, which further causes variations in coloration or color tone between areas which are overprinted and areas which are not, e.g., the redness of a red line printed over a grey underprint is visibly different from the redness of the same line extending onto unprinted areas of the sheet, due to variations in the ability of the sheet to quickly absorb the diluent/solvent. The same is true with respect to the lack of uniformity of surface appearance of a solvent-applied overcoating.

In cases where cost is not a factor and/or where the aesthetic advantages of a protective supercoating, generally referred to as a coating in the flexographic industry, are desired, it is known to provide the printing machine with a downstream coating station having a coating application unit for the application of an overall protective coating over the entire printed area of the copy sheets.

While the in-line application of a protective or aesthetic coating over the flexographic images on a succession of copy sheets will improve the appearance of the print and render it smear-resistant and weather-resistant, the relatively wet condition of the printing ink composition, particularly in overprinted areas, at the time that the coating composition is applied thereover, produces a visible change in the appearance of the portions of the coating overlying the printed images during the evaporation and/or absorption of the solvent, diluent, water, etc., whereby, for example, a glossy-surfaced protective coating acquires a non-uniform flat, matte, or non-glossy surface, particularly in areas overlying the multi-printed images, and even the affected areas are not uniform in appearance depending upon the colors and/or surface areas of the underlying printed images due to the solvent/diluent in the coating interacting with the still-wet color inks. For example, printed colored images, half-tone illustrations, and the like, which are intended to be emphasized or heightened in appearance, by the application of glossy coatings thereover, undergo loss or degradation in the uniformity of their appearance and their color during the drying of the coating.

These defects in color quality and coating appearance are of substantial importance in cases where the additional expense of one or more coatings is justified by the desired results, i.e., promotional displays, artwork, product containers, etc. The defects, i.e., uneven surface appearance of the coating(s) and the quality of the underlying color images, detract from the appearance of the coating and/or underlying images, particularly in the case of multi-colored images and are due to the presence of various amounts of residual volatile solvents, diluents, water, etc., within the flexographic inks of the first images at the time that the second flexographic images are applied thereover, and/or to the presence of volatile solvents, diluents or water within the second subsequent flexographic ink images at the time that the coating is applied thereover. The application of a top coating over the printed images retards the volatile solvent, diluent or water against escape in the final drying station, but the volatiles can eventually migrate from the cardboard into the top coating during the final drying of the printed cardboard, resulting in a loss of perfection in the surface finish of the top coating.

These problems have not been important in cases where the sheets being printed are cardboard shipping cartons or the like, where high quality is not considered important. However in some cases, such as with display cardboard and ultimate sale cardboard containers, such as shoe boxes, toy boxes, clothing closets, etc., where high quality, multi-color printing is important, it has been necessary to print an outer paper sheet by means of higher quality printing processes and then adhere or laminate the printed sheet to the cardboard support. This is expensive and labor-intensive. The present invention makes this unnecessary for many flexographic applications.

It is known to provide one or more drying stations between inking stations on continuous web flexographic printing machines. However such machines convey the copy sheet through a tortuous path and thus are only useful for printing flexible webs and not sheet lengths or cardboard blanks.

It is an object of the present invention to provide a novel flexographic printing and/or coating method and apparatus for the in-line application of one or more inks and/or protective or aesthetic coatings over imaged subject matter flexographically printed onto each of a succession of heavyweight, absorbent copy sheets while avoiding the usual degradation of sharpness, detail, color uniformity or loss of uniformity of the surface appearance of areas of the ink(s) and/or coating applied over the previously ink-printed images.

It is another objective of the present invention to provide a flexographic printing method and apparatus for providing high quality flexographic printing directly on heavyweight sheets, such as corrugated cardboard, thereby avoiding the need for pre-printing paper, such as by offset lithographic means, and thereafter adhering it to a cardboard support.

Essentially, the present invention is concerned with providing high quality flexographic copies of the types desired, directly on heavyweight absorbent sheets particularly in cases where the additional expense of multiple colors and supercoatings is justified by the desired results.

SUMMARY OF THE INVENTION

The present flexographic method and apparatus provides for the inline forced hot air drying of flexographic ink images, including multicolor images and photographic reproductions, printed or applied at one liquid application station before the application of a second printing ink or a continuous or spot coating over said ink images at the next downstream liquid application station by interposing an in-line drying station between each of said liquid application stations in order to predry the first colored ink images prior to the application of images of a second color or a final coating thereover, whereby the drying of each ink removes volatile solvents/diluents which can cause the ink images to spread or broaden, and/or blemish the next ink or coating applied thereover.

The evaporation of volatile solvents/diluents from flexographic ink images applied to stiff, absorbent sheets is unknown and unobvious since such images are intended to dry by absorption of the volatile solvents/diluents and oil of the ink into the absorbent paper sheet, such as the outer paper ply of a corrugated cardboard. However I have discovered that the interstation evaporation of such volatiles dries the ink images before they can spread, bleed or wick into the absorbent paper support, thus preserving their sharpness, detail and coloration. Moreover such evaporation dries the surfaces of the first printed images so that they are more receptive to second images or coatings applied thereover and more resistant to being diluted, spread and/or broadened by the volatiles present in the second applied images or coating. Moreover the pre-removal of the volatile avoids the accumulation of volatiles, in different quantities, in different areas of the printed copy sheets or cardboard sheets, depending upon the number of overprints, the presence of which can continue to cause the images to spread or broaden and/or can result in color degradation and degradation in the uniformity of the appearance of an overcoating, if present.

The present invention is concerned with drying or solvent/diluent evaporation prior to the application of a second ink or a supercoating over the printed images.

The coating compositions conventionally used to apply protective or aesthetic coatings over printed images are aqueous solutions, dispersions or emulsions of water-dispersible or water-soluble film-forming binder materials, such as acrylic resins, hydrophilic colloids, vinyl alcohol, etc. Also, coating compositions free of volatile solvents or vehicles are commonly used, such as resin precursor compositions which are polymerizable or curable by exposure to ultraviolet or other radiation. Such compositions are based upon liquid acrylic monomers or pre-polymers, or photopolymers and photoinitiators, cross-linking agents and/or other conventional ingredients. Both solvent-applied and solvent-free coating compositions can produce microporous coatings which are permeable to volatiles. While they are permeable to volatile ink solvents, diluents and water, the escape of these volatiles mars the appearance of the surface finish of the coatings, as discussed supra.

Multicolor flexographic printed ink images commonly are formed by using inks containing pigments of different primary colors which, when combined in superposition, produce different secondary colors depending upon the identity and number of primary colors used. However, unless each ink image is dried sufficiently to evaporate the solvents and water present therein, before a second ink is printed in partial or full registration thereover, said solvents and water produce blemishes in the total image when they are eventually evaporated. Such blemishes include voids uneven tones, ragged edges, etc.

Another problem, pertinent to the embodiment of drying between printing stations, relates to the reduced receptivity of wet images for images and/or supercoatings applied thereover, producing uneven, discontinuous or spotty images or supercoatings having "holidays" or areas which have not accepted the images or supercoating.

The novel flexographic method and apparatus of the present invention overcomes these problems with stiff, heavyweight absorbent sheets by drying the ink-imaged copy sheets prior to the application of additional ink images and/or prior to the application of a coating over the ink-printed images, whereby substantially-perfect flexographic images and/or coatings having excellent uniformity, color tone and surface properties, such as gloss, are produced on stiff copy sheets, such as cardboard, printed and/or coated in a straight line flexographic apparatus.

THE DRAWING

FIG. 1 is a vertical cross-sectional view of a flexographic printing and punching machine, illustrating four liquid application stations and the interposition of inline drying stations between each of the liquid application stations and including a final downstream in-line drying station in advance of an optional die cutting, folding and/or gluing creasing station.

DETAILED DESCRIPTION

Figure 1:
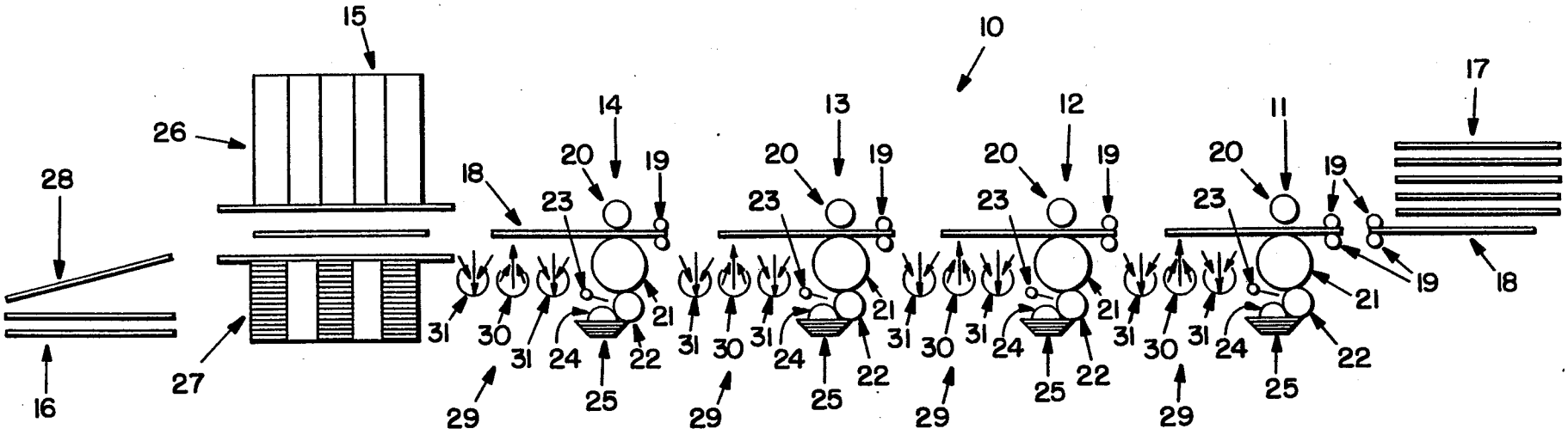

Referring to the drawing, FIG. 1 illustrates a flexographic printing machine 10 comprising four liquid application stations 11, 12, 13 and 14 the final downstream station 14 being a coating station, if desired, an an optional die cutting, creasing, folding and/or gluing station 15 at which the printed cardboard copies are die cut into desired shapes, such as carton blanks, and creased for folding purposes, if desired, prior to stacking at 16.

As illustrated, the present apparatus includes a feeding station 17 for feeding a continuous supply of cardboard blanks or sheets 18 in a straight line between a plurality of feed rolls 19 into and through each of the liquid application stations 11 to 14 in which each sheet 18 is engaged between an upper impression cylinder 20 and a lower printing cylinder 21. The printed blanks 18 are finally fed to a cutting and creasing press station 15 in which they are die cut and creased, and moved to a stack 16.

Each of the flexographic printing stations 11 to 14 comprises a flexographic plate cylinder 21, the final downstream one of which, in station 14, can be one for printing an overall or spot coating over the portions of the sheet 18 printed with ink images in stations 11, 12 and 13. The liquid application systems in stations 11 to 14 each comprise the plate cylinder 21, a metering roll 22 with associated doctor blade 23, an application roll 24 and an ink (or coating) supply 25. The illustrated ink (or coating) supply 25 is a pan into which the roll 24 extends to receive a continuous supply of the ink or coating composition as it is rotated in the counter-clockwise direction. However most commercially available flexographic printing machines pump the ink or coating supply as a continuous supply onto the surface of the applicator roll 24. The doctor blade 23 is adjustable relative to the surface of the metering roll 22 in order to control the thickness of the ink or coating layer moved onto the plate surface on the plate cylinder 21 for transfer to the undersurface of each cardboard sheet 18.

The apparatus includes conventional registration means, including feed rolls 19, so that each sheet 18 and the plate on each printing cylinder 21 are in exact registration to precisely control the areas of each sheet 18 to be printed with different colored inks at stations 11 to 14 or to be printed with coating composition at station 14.

The multi-printed sheets 18 are moved into the optional station 15, which includes a movable cutter/-crease die 26 and an anvil 27, in order to cut away and/or crease predetermined portions thereof to form printed blanks 28 which are stacked at 16.

The essential novelty of the present flexographic printing apparatus resides in the plurality of interstation driers 29, one or more of which are located after each of the printing stations 11 to 14 for purposes of rapidly drying the ink images applied to sheets 18 at each printing station 11 to 13 before the printed sheets enter the next printing station and to dry the final ink or coating after print station 14. This has been found to result in substantially sharper, clearer images being produced on the cardboard sheets as compared to conventional straight line flexographic printers which permit the images to dry by absorption of the volatile ink solvent-/diluent into the cardboard surface. Moreover the present apparatus has been found to permit the overprinting of different colored inks in partial or complete registration without dilution or spreading or alteration of the sharpness or color tone of the underlying images. The pre-drying of the underlying images sets their color and sharpness, preventing them from being spread and diluted by absorption by the cardboard sheet. Moreover the pre-drying of the images renders them more resistant to being redissolved and spread or diluted by the volatile solvent/diluent of the next-applied ink, and provides a pre-dried ink surface which is more receptive to being overprinted with the next-applied ink and is resistant to being drawn back off the cardboard surface by the pressure of the next ink printing cylinder 21.

Referring to FIG. 1, each interstation drier 29 comprises at least one elongate tubular forced hot air knife 30 which is closely-spaced from the printed undersurface of the sheets 18, and an associated pair of elongate tubular vapor suction means 31 for withdrawing the evaporated ink vehicle or solvent to a recovery unit or for safe release to the outside atmosphere.

In operation, the inked plate on the first flexographic cylinder 21 is rotated against the ink-receptive surface of each cardboard sheet 18, to which the wet flexographic ink images are transferred to form an image-printed copy sheet 18. Each sheet 18 is conveyed, imaged face down, through a first drying interstation 29, comprising at least one forced hot air knife 30 and a spaced pair of vapor-extraction units 31 which withdraw and convey the volatile vehicle vapors to a recovery unit, to the atmosphere or for other safe disposal.

As illustrated, each printed copy sheet 18 is conveyed past the first air knife 30 to form a dried printed copy sheet which is moved into the next liquid application station 12.

The air knife 30 and the extraction units 31 are conventional elements normally used as final drying elements on printing and coating machines of different types, and are sufficiently small in diameter, i.e., about two inches, that they can be accommodated within the small areas present between printing stations on conventional straight-line flexographic printing machines. Knives 30 are elongate tubular elements provided with an elongate narrow slot formed by opposed, converging walls. Heated air is circulated through the tubular elements under pressure and is expelled from the elongate slot as a concentrated narrow band of high speed hot air which is directed against the undersurface of the ink-printed copy sheets 18 to evaporate the volatile solvent or vehicle therefrom to release vapor which is withdrawn through elongate slots in the extraction units 31. Substantial drying is produced by the each air knife 30, but a spaced second air knife may be included at each drying station 29 to insure complete drying prior to the entry of the copy sheets 18 to the next liquid application station.

In the apparatus of FIG. 1, the second ink application station 12 is another ink printing station, such as for printing ink of a second color. Thus the various elements of station 12 are numbered similarly to those of station 11.

The printed copy sheets 18 exiting the second printing station 12 are moved by feed rollers 19, printed side down, through the second drying interstation 29 which is similar to the first drying station and comprises a similar elongate air knife 30 and a similar spaced pair of extraction units 31.

The line of forced hot air from the second knife 30, across the width of the copy sheets printed in station 12, substantially dries the second-applied ink images by evaporating the vehicle therefrom, after which the dried, copy sheets 18 are conveyed by downstream feed rollers 19 for entry of the twice printed copy sheets 18 into the next printing station 13 where ink images of a third color are printed over the pre-applied, pre-dried ink images, and are dried at the next downstream interstation drier 29 prior to entry into the final printing station 14. The final downstream station 14 can, if desired, be a coating application station which is similar to the inking stations 11 to 13 with respect to flexographic plate cylinder 20 and its associated rollers, except that the plate has an overall or spot coating surface, and coating composition rather than ink is fed thereto from supply 25.

Thus, the station 14 can be a coating station for the application of continuous spot coatings onto the pre-dried printed copy sheets 18 which are transported by feed rollers 19 past a final downstream drying station 29 and its air knife 30 to evaporate the water or other volatile solvent/diluent from the coating and form final copies 18 which are cut, creased, folded and/or glued and stacked.

In operation, a succession of cardboard copy sheets 18 is automatically moved in a straight line by feed roller 19 and transported through two or more ink printing stations into printing contact with two or more flexographic cylinders 21 to print images, such as of different colors, on predetermined similar and/or different areas of the underside of each copy sheet, using conventional aqueous flexographic inks containing volatile organic solvents(s) and water At each ink-printing station 11 to 14 a flexographic printing plate is fastened to a plate cylinder 21 and inked by means of metering roller 22. The ink is selectively received by the image areas of the plate and transferred to the under-surface of a copy sheet 18 passed in the nip of cylinder 21 and impression cylinder 20. At this point, the ink images on each imaged copy sheet 18 still contain the volatile organic solvent and water. Rather than moving the inked copy sheets 18 directly from the first ink printing station to the next ink printing station 12, as is conventional in the art, the present method and apparatus provides for intermediate or interstation drying of the inked copies to evaporate the volatile organic solvent from the ink images and copy sheet to form solvent-free copies 18 prior to the application of new ink images thereover.

Flexographic processes are conventionally used to print ink images onto absorbent paperboard, drying of the ink images being caused by the absorption of the volatile ink vehicle into the copy sheet. Heretofore it has not been possible to apply high quality multicolor ink images onto cardboard in a single pass on straight line flexographic machines because the volatile solvent-/diluent of the after-applied ink images redissolves and smears the first applied images which mask the absorbent copy sheet against rapid absorption of the after-applied solvent. The same problem occurs when solvent/diluent-applied coating compositions are applied over ink images in the flexographic process.

The present invention solves these problems by providing the interstation forced hot air driers between each of the liquid application stations on a straight line flexographic printing and/or coating apparatus, whereby the volatile solvents and water are evaporated to dry the ink images rapidly before additional images or coatings are printed thereover. Rapid evaporation drying renders the dry ink images resistant to being dissolved or smeared, and reduces the dwell time of the after applied solvents. Conventional drying by absorption is very slow, does not remove the solvents, diluents or water from the copy sheets and retards drying in cases where the later applied composition is applied over pre-printed areas of the absorbent copy sheet.

Thus the present flexographic printing process makes it possible to print stiff cardboard copy sheets, even those which have little or no porosity and little or no absorbing ability, such as cardboard having a printing face of high quality non-absorbant paper or plastic-coated cardboard, corrugated plastic board, and other similar materials on which quality images could not be printed by conventional flexographic printing processes.

It is to be understood that the above described embodiments of the invention are illustrative only and that modifications throughout may occur to those skilled in the art. Accordingly, this invention is not to be regarded as limited to the embodiments disclosed herein, but it to be limited as defined by the appended claims.

What is claimed is:

1. In a flexographic, straight line printing machine comprising a plurality of liquid application stations each comprising a printing cylinder, at least one of which is an upstream ink printing station for the printing of ink images containing a volatile solvent/diluent onto a succession of individual cardboard copy sheets as such sheets are moved therethrough, and at least one of which is a downstream printing station , and means for continuously feeding said individual copy sheets, without bending, through said liquid application stations, the improvement which comprises an intermediate drying station comprising at least one forced hot air means positioned between each of said liquid application stations to apply a line of forced hot air across the direction of travel of said sheets as they move therepast to effect the evaporation of the solvent/diluent from the ink images printed on said cardboard copy sheets prior to the movement of the ink-imaged copy sheets into the next liquid application station, to effect the drying of said images prior to the application of the rink images or a coating thereover.

2. A flexographic, straight line printing machine according to claim 1 in which one or more of the downstream application stations comprise coating stations for the application of spot coatings or continuous coatings, to said copy sheets.

3. A flexographic, straight line printing machine according to claim 1 in which each said intermediate drying station also comprises a vapor extraction means.

4. A flexographic straight line printing machine according to claim 1 which further comprises a final station for cutting the printed cardboard copy sheets.

5. A flexographic, straight-line printing machine according to claim 1 comprising at least two adjacent ink printing stations for printing ink images of different colors in partial or complete registration on said cardboard copy sheets.

6. A method for the flexographic printing of a succession of cardboard copy sheets on a continuous straight line, flexographic printing machine which comprises the steps of continuously feeding a succession of individual cardboard copy sheets, without bending, through a plurality of liquid application stations, each having a printing cylinder, including at least one upstream ink printing station and one or more downstream stations, printing images comprising volatile solvent-/diluent-containing ink onto said copy sheets as they move through each of said ink-printing stations to form imaged copy sheets, heating said imaged sheets after each ink-printing station by moving them past forced hot air which applies a line of forced hot air across the direction of travel of said sheets to substantially-completely evaporate the volatile solvent/diluent therefrom to form dry imaged copy sheets, prior to movement thereof into the next liquid application station.

7. A method according to claim 6 in which one of said downstream printing stations comprises a coating station in which a coating is applied which covers the dry images printed at the ink printing stations.

8. A method according to claim 7 in which a said coating is applied comprising a partial or spot coating which overlies only a portion of the dry images printed at the ink printing stations.

9. A method according to claim 6 in which drying is accomplished by directing a narrow line of forced hot said air from air knives against said imaged copy sheets.

10. A method according to claim 6 in which the evaporated solvent/diluent is extracted from the area at which it is evaporated.

11. A method according to claim 6 which comprises printing ink images of different colors in partial or complete registration at at least two adjacent ink printing stations.

* * * * *